US007241251B2

(12) United States Patent
Patterson

(10) Patent No.: US 7,241,251 B2
(45) Date of Patent: Jul. 10, 2007

(54) HAND-HELD EXERCISE DEVICE ASSEMBLY INCORPORATING A VARIABLE STABILITY STRENGTH OVERLOAD DISTRIBUTION SYSTEM

(76) Inventor: Paul Patterson, 87 Ch. Pic Bois, Val Des Monts, Quebec (CA) J8N-6C4

( * ) Notice: Subject to any disclaimer, the term of this patent is extended or adjusted under 35 U.S.C. 154(b) by 0 days.

(21) Appl. No.: 11/205,546

(22) Filed: Aug. 16, 2005

(65) Prior Publication Data

US 2006/0035763 A1 Feb. 16, 2006

Related U.S. Application Data

(60) Provisional application No. 60/601,862, filed on Aug. 16, 2004.

(51) Int. Cl.
*A63B 21/06* (2006.01)

(52) U.S. Cl. ..... 482/93; 482/44; 482/105; 482/108

(58) Field of Classification Search ..... 482/44–46, 482/49, 92–94, 105–108, 50, 139
See application file for complete search history.

(56) References Cited

U.S. PATENT DOCUMENTS

| | | | | |
|---|---|---|---|---|
| 113,966 | A * | 4/1871 | Ballou | 482/108 |
| 757,041 | A * | 4/1904 | Hosfeld | 482/105 |
| 3,185,476 | A * | 5/1965 | Fechner | 473/596 |
| 3,347,240 | A * | 10/1967 | Rigler | 607/77 |
| 4,902,005 | A * | 2/1990 | McNeill | 482/93 |
| 5,498,221 | A * | 3/1996 | Blair, Jr. | 482/99 |
| 5,709,637 | A * | 1/1998 | Gow et al. | 482/129 |
| 6,110,080 | A * | 8/2000 | Niv | 482/105 |
| 6,413,193 | B1 * | 7/2002 | Geller et al. | 482/105 |
| 6,461,282 | B1 * | 10/2002 | Fenelon | 482/106 |
| 6,561,958 | B2 * | 5/2003 | Pappert | 482/105 |
| 6,569,066 | B1 * | 5/2003 | Patterson et al. | 482/99 |
| 6,837,833 | B2 * | 1/2005 | Elledge | 482/108 |
| 2006/0073951 | A1 * | 4/2006 | Walkow | 482/109 |
| 2006/0116256 | A1 * | 6/2006 | Carney | 482/106 |

* cited by examiner

*Primary Examiner*—Jerome Donnelly
*Assistant Examiner*—Victor K. Hwang
(74) *Attorney, Agent, or Firm*—Mike Bush PLLC

(57) ABSTRACT

A hand-held exercise device exercise device incorporating a variable stability strength overload distribution system resulting from the even or uneven distribution of weight relative to a center of gravity thereof. The even or uneven distribution of weight providing the variable stability strength overload distribution system results from the attached of a selected number of weights along first, second and/or third planes, each generally parallel to a handle assembly thereof.

17 Claims, 5 Drawing Sheets

HAND-HELD EXERCISE DEVICE ASSEMBLY INCORPORATING A VARIABLE STABILITY STRENGTH OVERLOAD DISTRIBUTION SYSTEM

CROSS REFERENCE TO RELATED APPLICATIONS

This application is related to, and claims priority under 35 U.S.C. § 119(e), from U.S. provisional patent application Ser. No. 60/601,862 filed Aug. 16, 2004 and hereby incorporated by reference as if reproduced in its entirety.

STATEMENT REGARDING FEDERALLY SPONSORED RESEARCH OR DEVELOPMENT

Not Applicable.

REFERENCE TO A MICROFICHE APPENDIX

Not Applicable.

FIELD OF THE INVENTION

The invention relates to hand-held exercise devices and, more particularly, to hand-held exercise devices incorporating a variable stability strength overload distribution system resulting from the even or uneven distribution of weight relative to a center of gravity thereof.

BACKGROUND OF THE INVENTION

Hand-held exercise devices are well known in the art, the best known of which is the hand-held dumbbell. The components of a hand-held dumbbell include a metal bar, a sleeve, two lockable collars and, if desired, plate weights. Typically, the metal bar is about one inch in diameter and about eight to twelve inches in length. The sleeve is formed of a chrome-plated metal and is slid onto the metal bar and positioned in the general center thereof. Oftentimes, the sleeve is knurled to enhance the ability to grip in use. The collars, which are commonly formed from either metal or plastic, are slid over the metal bar, one from each end thereof, and locked into place upon contacting the sleeve, thereby fixedly securing the sleeve in the general center of the metal bar. One or more plate weights may then be slid onto respective ends of the bar such that a generally identical weight is positioned on each end of the sleeve. If plate weights are used with the dumbbell, two additional lockable collars are then slid over respective ends of the metal bar and locked to fixedly secure the plate weights in place. In normal use, a pair of hand-held dumbbells of generally identical weight are held, one in each hand and a variety of exercise routines are performed. While various improvements in hand-held dumbbell design have been made over the years, for example, the development of single piece cast iron or steel hand-held dumbbells and/or vinyl coated hand-held dumbbells, the basic design of the hand-held dumbbell has remained unchanged over the years.

When used in exercise routines, the predominant biomechanical characteristic of a traditionally configured hand-held dumbbell is that, once grasped by the hand, the center of gravity of the hand-held dumbbell is in the middle or center of the fist. Furthermore, the moment arm of resistance derived from a traditionally configured hand-held dumbbell is the distance from the center of gravity to the articulation point of the wrist, a distance typically on the order of about three inches. When used in an exercise routine, the hand-held dumbbell has no significant moment arm variations. Accordingly, the use of a traditionally configured hand-held dumbbell may be characterized as an isometrically fixed hand-wrist position hereinafter referred to as a "dead-hand" position. Although wrist-extension and wrist-flexion exercises may be performed using a traditionally configured hand-held dumbbell, they are typically performed by stabilizing the forearms on the thighs or on a so-called "preacher's bench" during the exercise routine. Similarly, while exercise routines involving torque or rotational hand-wrist movements are possible using a traditionally configured hand-held dumbbell, such movements are only possible because generally equal weights are secured on opposite sides of the gripping sleeve, a placement which, in effect, results in an equal amount of weight on each side of the center of gravity. As a result, the torque resistance is essentially zero and, once established, rotational momentum tends to stimulate hand-wrist rotational movement. Because of this, traditionally configured hand-held dumbbells are rarely used to perform rotary exercises routines since they are largely ineffective in producing rotary muscle mass and strength gains.

For the foregoing reasons, the traditionally configured hand-held dumbbell is not particularly useful in any number of exercise routines. It should be readily appreciated, therefore, that it would be advantageous to provide a hand-held exercise device suitable for those exercise routines for which the traditionally configured hand-held dumbbell has proven deficient.

SUMMARY OF THE INVENTION

In accordance with the present invention, there is provided a hand-held exercise device which includes a generally tubular sidewall and at least one weight attached to said generally tubular sidewall such that an even or uneven distribution of weight relative to a center of gravity results. It is this even or uneven distribution of weight which provides the hand-held exercise device with the variable stability strength overload distribution system.

NOTATION AND NOMENCLATURE

Certain terms used throughout the following description and claims are intended to have certain meanings. The meaning of such terms are set forth hereinbelow. It should be noted, however, that, by providing definitions of the foregoing terms, this document does not intend to distinguish between components that differ in name but not function.

The term "couple" or "couples" is intended to mean either an indirect or direct mechanical connection. Thus, if a first component is coupled to a second component, that connection may be through a direct connection or through an indirect connection via other components and connections.

The term "dead hand position" is intended to refer to a positioning of the hand/wrist characterized by a mid-range wrist-extension—wrist flexion, an essentially pronated wrist position and a mid-range ulnar-radial deviation The terms "including" and "comprising" are used in an open-ended fashion, and thus should be interpreted to mean "including, but not limited to . . . ".

The term "integral" is intended to encompass both structures formed from a single component as well as structures formed from multiple components which are coupled, connected or otherwise mated together to form the structure.

The term "pronation" is intended to refer to a repositioning of the hand/wrist complex such that the palm of the hand turns away from the face.

The term "supination" is intended to refer to a repositioning of the hand/wrist complex such that the palm of the hand turns towards the face.

The term "radial deviation" is intended to refer to a repositioning of the hand such that the hand is deviated from the longitudinal axis of the forearm towards the "thumb" side of the hand.

The term "ulnar deviation" is intended to refer to a repositioning of the hand such that the hand is deviated from the longitudinal axis of the forearm towards the "little finger" side of the hand.

The term "wrist extension" generally refers to a repositioning of the hand such that the back of the hand moves towards the elbow.

The term "wrist flexion" generally refers to a repositioning of the hand such that the palm of the hand moves towards the elbow.

DETAILED DESCRIPTION

Figure 1:
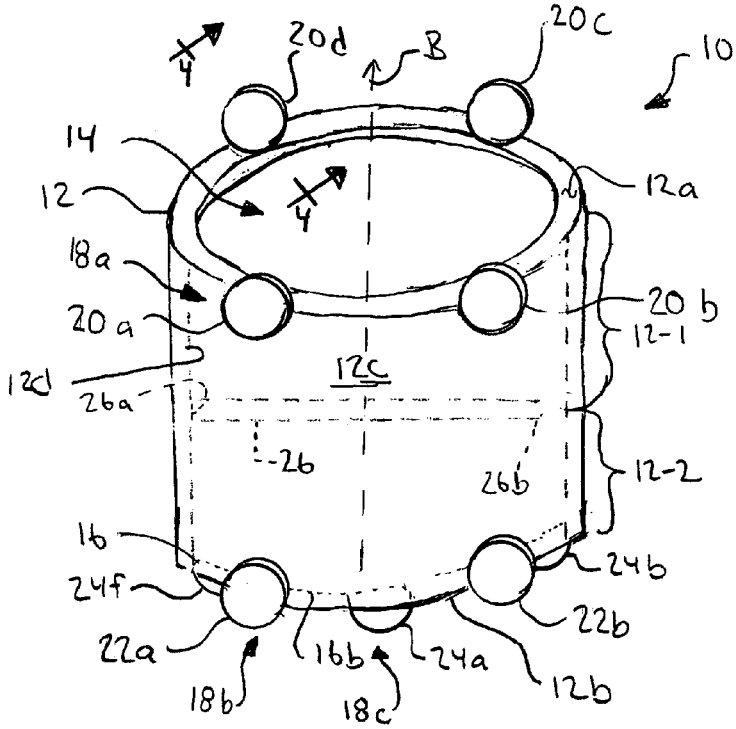
FIG. 1 is a perspective view of a hand-held exercise device constructed in accordance with the teachings of the present invention.

Referring first to FIG. 1, a hand-held exercise device constructed in accordance with the teachings of the present invention and incorporating a variable stability strength overload system will now be described in greater detail. In simple terms, a variable stability strength overload system is achieved in a hand-held exercise device through the use of structural surfaces outside the center of gravity of the hand-held exercise device and the hand or, more specifically, the fist, used to grasp the hand-held exercise device. Such a hand-held exercise device is illustrated in FIG. 1 and shall be described hereinbelow.

As may now be seen, the hand-held exercise device 10 is comprised of a generally tubular sidewall 12 which defines an interior space 14. The tubular sidewall 12 is comprised of an upper side surface 12*a*, a bottom side surface 12*b*, an exterior side surface 12*c* and an interior side surface 12*d* (shown in phantom in FIG. 1). As will be more fully described below, the so-called "tube" defined by the sidewall 12 is closed on one end by a plate 16 (also shown in phantom in FIG. 1). As will be more fully described below, mounted to the sidewall 12 and plate 16 is a weight set, comprised of a plurality of weights, the use of which, in combination with the structure of the hand-held exercise device 10 itself, provide the hand-held exercise device 10 with the variable stability strength overload system hereinabove described.

As disclosed herein, the weights are in a generally spherical or "ball" shape. It is fully contemplated, however, that the weights may be configured in a variety of shapes other that disclosed and illustrated herein. It is further contemplated that the weight set may be (a) comprised of various numbers of weights, (b) comprised of various arrangements of weights, (c) formed of a variety of materials, for example, steel or wood and/or (d) be comprised of different weight sets ranging from about 0.5 pounds per weight to about 1.1 pounds per weight. Of course the foregoing range for weight sets to be used in connection with the hand-held exercise device is purely exemplary and it is fully contemplate that other weight sets will be suitable for the purposes contemplated herein.

The weight set mounted to the sidewall 12 and the plate 16 is comprised of weight arrays 18*a*, 18*b* and 18*c*. In the embodiment disclosed in FIG. 1, the array 18*a* is comprised of first, second, third and fourth weights 20*a*, 20*b*, 20*c* and 20*d*, each of which are coupled to the sidewall 12 of the hand-held exercise device 10. Similarly, the array 18*b* is comprised of first, second, third and fourth weights 22*a*, 22*b*, 22*c* and 22*d*, each of which is coupled to the sidewall 12 of the hand-held exercise device 10 and only three of which are visible in FIG. 1. Finally, the array 18*c* is comprised of first, second, third, fourth, fifth and sixth weights 24*a*, 24*b*, 24*c*, 24*d*, 24*e* and 24*f*, each of which is coupled to the plate 16 of the hand-held exercise device and only two of which are visible in FIG. 1. As illustrated in FIG. 1, each of the arrays 18*a*, 18*b* and 18*c* are at full capacity, i.e., the arrays are comprised of the maximum number of weights that the hand-held exercise device 10 is capable of accommodating. Of course, it is fully contemplated that the arrays 18*a*, 18*b* and 18*c* may include any number of weights up to the maximum number that the handheld exercise device 10 is capable of accommodating. For example, the array 18*a* may be comprised of any number of weights between 1 and 4. Similarly, the array 18*b* may be comprised of any number of weights between 1 and 4 while the array 18*c* may be comprised of any number of weights between 1 and 6.

Thus, in various configurations of the hand-held exercise device illustrated in FIG. 1, it is contemplated that one or more spherical balls, all having a common weight between one-half and one pound, may be attached to the surface of the hand-held exercise device 10 in the following overload patterns: (a) an array 18*a* comprised of one, two, three or four weighted balls mounted to the upper side surface 12*a* of the sidewall 12—a pattern which would place the weights proximal to the hand-wrist complex; (b) an array 18*b* comprised of one, two, three or four weighted balls mounted to the lower side surface 12*b* of the sidewall 12—a pattern which would pace the weights distal from the hand-wrist complex; (c) an array 18*c* comprised of one, two, three, four, five or six weighted balls attached to a lower side surface 16*b* of the plate 16; or (d) one or more weighted balls attached to the exterior side surface 12*c* of the sidewall 12 of the hand-held exercise device 10 with more weighted balls (or, if desired, all of the weighted balls) on one side of the hand-held exercise device 10 to create a third dimension of movement commonly referred to as torque resistance. Such an overload pattern may be seen by reference to FIG. 6. In all of the foregoing overload patterns, weighted balls may be attached preferentially to one side of the hand-held exercise device 10 only to maximize torque resistance/torque stimulus.

Figure 2:
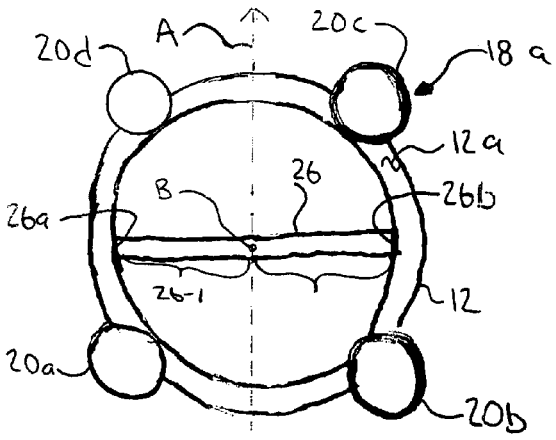
FIG. 2 is a top side view of the hand-held exercise device of FIG. 1.

FIG. 2 is a top side view of the view of the hand-held exercise device 10. As may now be better seen, the first, second, third and fourth weights 20*a*, 20*b*, 20*c* and 20*d* forming the first array 18*a* are fixedly mounted to the sidewall 20 in a spaced arrangement such that each of the first, second, third and fourth weights 20*a*, 20*b*, 20*c* and 20*d* is at a 45° angle relative to longitudinal axis A. As may be further in FIG. 2, the hand-held exercise device 10 further includes a handle 26 for grasping the hand-held exercise device 10. As illustrated in FIG. 2, the handle 26 is positioned at a generally orthogonal angle relative to the longitudinal axis A and is fixedly mounted to the sidewall 12 at first and second ends 26*a* and 26*b* thereof in a manner to be more fully described below. It should be clearly understood, however, that the orientation of the handle 26 relative to the longitudinal axis A and the sidewall 12 illustrated in FIG. 2 is purely exemplary and it is specifically contemplated that a wide variety of orientations other than that shown in FIG. 2 is are suitable for the purposes disclosed herein. For example, the handle 26 may be positioned at a 45° angle relative to the longitudinal axis A. Regardless, however, for all of the orientations of the handle 26 relative to the longitudinal axis A and the sidewall 12 contemplated herein, it is generally preferred (but by no means required) that the handle 26 intersect the longitudinal axis A in the general center thereof, i.e., that section 26-1 of the handle 26 is roughly the same length as section 26-2 of the handle 26. Along the vertical axis B, the handle 26 is fixedly mounted to the sidewall 12 at a location intermediate the upper side surface 12*a* and the lower side surface 12*b* thereof. Again, it is generally preferred (but by no means required) that the handle 26 is fixedly mounted to the sidewall 12 approximately halfway between the upper side surface 12*a* of the sidewall 12 and the lower side surface 12*b* of the sidewall 12, i.e., the section 12-1 of the sidewall 12 is roughly the same length as section 12-12 of the sidewall 12.

Figure 3:
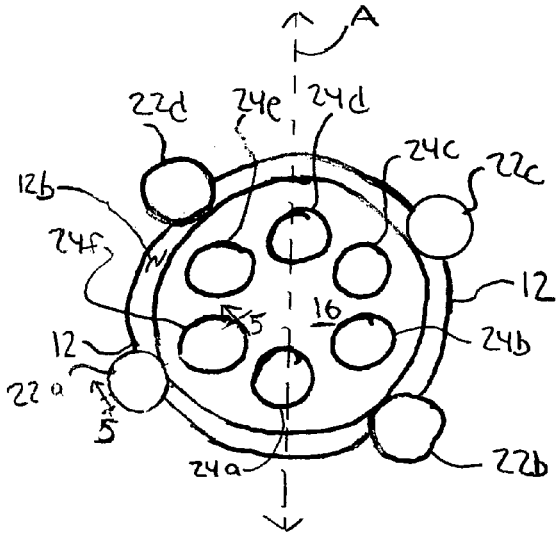
FIG. 3 is a bottom side view of the hand-held exercise device of FIG. 1.

FIG. 3 is a bottom side view of the hand-held exercise device 10. As may now be seen, the first, second, third and fourth weights 22*a*, 22*b*, 22*c* and 22*d* forming the second array 18*b* are fixedly mounted to the sidewall 20 in a first spaced arrangement in which each of the first, second, third and fourth weights 22*a*, 22*b*, 22*c* and 22*d* is at a 45° angle relative to longitudinal axis A. As may be further seen, the first, second, third, fourth, fifth and sixth weights 24*a*, 24*b*, 24*c*, 24*d*, 24*e* and 24*f* forming the third array 18*c* are fixedly mounted to the plate 16 in a second spaced relationship in which the first, second, third, fourth, fifth and sixth weights 24*a*, 24*b*, 24*c*, 24*d*, 24*e* and 24*f* are at 0°, 60°, 120°, 180°, 240° and 300° relative to the longitudinal axis A. The plate 16 to which the first, second, third, fourth, fifth and sixth weights 24*a*, 24*b*, 24*c*, 24*d*, 24*e* and 24*f* are fixedly mounted is generally parallel to a first plane defined by the upper side surface 12*a* of the sidewall 12 and to a second plane defined by the lower side surface 12*b* of the sidewall 12. As disclosed herein, the plate 16 is positioned between the handle 26 and the lower side surface 12*b* of the sidewall 12 and preferably positioned in greater proximity to the lower side surface 12*b* than to the handle 26.

Having described in detail the configuration of the hand-held exercise device 10, the bio-mechanical characteristics of the hand-held exercise device 10 and the associated advantages resulting from various exercise routines performed using the hand-held exercise device 10 will be described in greater detail. To do so, however, it will be necessary to review not only the anatomical movement of the hand-wrist complex but also the implications of hand-wrist movement on the elbow and shoulder related musculature and joint structures. Briefly, however, the hand-held exercise device 10 described and illustrated herein uniquely enables hand-wrist exercise by enabling the hand-wrist complex to be exercised and trained over the entire anatomical movement agenda including (a) hand-wrist extension-flexion, (b) hand-wrist supination-pronation, (c) hand-wrist radial-ulnar deviation. By enabling the foregoing anatomical movements, exercise routines performed using the hand-held exercise device 10 may, in contrast to the dead hand exercises resulting from the use of a traditionally configured dumbbell, be characterized as "live hand" exercises.

The upper extremity of the human body, oftentimes called the "kinetic chain", is comprised of a three-joint complex: the hand-wrist, the elbow and the shoulder. The implications of using a hand-held exercise device, for example, the hand-held exercise device 10, equipped with a variable stability strength overload system are significant. For example, traditional two-dimensional type exercises include, among others: (a) hinge-type bicep curl with hand-wrist in the supinated, i.e., elbow flexion, position; (b) shoulder flys, with traditionally configured dead hand dumbbells, i.e., shoulder, abduction/adduction, extension/flexion; (c) triceps extensions, i.e., elbow extensions, in either a first position in which the torso is generally horizontal and the face is in the up position or a second position in which the torso is generally upright and the elbow is extended over the head; (d) wrist extensions, an exercise performed in the seated position with the forearms stabilized against the thighs and hands pronated throughout; and (e) wrist flexions, an exercise in which the forearms are stabilized against the thights and the hands supinated throughout, may now be performed with a full, three-dimensional range of motion with live hand action throughout. In fact, movements such as the right arm motion which occurs during a golf swing, the left arm motion which occurs during a golf swing and the throwing motion which occurs in baseball and football may now be performed/exercised in a live hand, three joint complex, fully coordinated movement pattern.

It should be noted that the three pairs of possible hand/wrist movements are usually performed in two coordinated sets of three movements—a pronation/flexion/ulnar deviation of the hand/wrist and a supination/extension/radial deviation of the hand/wrist. The pronation/flexion/ulnar deviation of the hand/wrist may be best envisioned as the hand/wrist of a baseball pitcher when releasing a baseball. The supination/extension/radial deviation of the hand/wrist may be best envisioned as the hand-wrist of the baseball pitcher at the end of the wind-up and before actually beginning the pitch.

From the foregoing description, it should now be clear that the various configurations possible for the attachment of weight balls to the outer side surfaces 12*a*, 12*b* and 12*c* of the sidewall 12 and the lower side surface 16*b* of the plate 16 create multiple moment-arm variations such that an elevation of strength-stability and strength complexity stimulus throughout the hand/wrist to the entire upper extremity kinetic chain has been raised to a heretofore unknown level by the variable stability strength overload distribution system incorporated into the hand-held exercise device 10.

Furthermore, it should be noted that, during a single exercise repetition of the hand-held exercise device 10 using the ball-weight system only, the pattern of derived moment arms based upon the location of ball attachment with respect to the location of the center of gravity of the combination of the unloaded hand-held exercise device 10 and the fist grasping the unloaded hand-held exercise device 10 is not static. More specifically, as vertical axis B of the hand-held exercise device 10, the axis which extends through the a first plane defined by the lower side surface 12*b* of the sidewall 12, the center of gravity and a second plane defined by the upper side surface 12*a* of the sidewall 12, changes relative to the (1) axis of the forearm, elbow extension/flexion/rotation, shoulder rotation/adduction-abduction/extension-flexion and/or any combination of the foregoing; (2) vector representing gravity; and (3) speed of movement and the attendant phases of braking movement, acceleratory movement and static holds during normal exercise. Accordingly, the training resistance provided by the hand-held exercise device 1 is truly dynamic, unique and, in contrast to conventionally configured hand-held exercise devices, accommodates the complete anatomic agenda of the hand-wrist/elbow/shoulder upper extremity complex.

Figure 4:
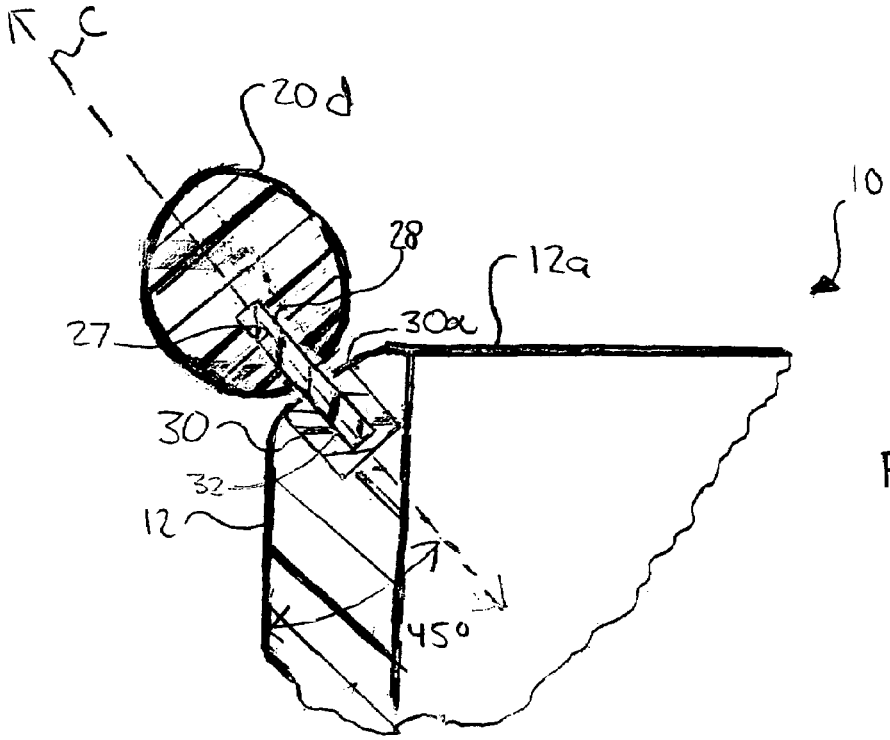
FIG. 4 is a partial cross-sectional view taken along lines 4—4 of FIG. 1.

FIG. 4 is a partial cross-sectional view taken along lines 4—4 of FIG. 1 to illustrate further details as to the mounting of the weight 20*d* to the sidewall 12. Of course, while the mounting of a single weight, specifically the weight 20*d* to the sidewall 12 is shown in FIG. 4, it should be clearly understood that the weights 20*a*, 20*b*, 20*c*, 22*a*, 22*b* and 22*c* may be similarly mounted to the sidewall 12 in the respective positions illustrated in FIG. 1–3. Likewise, it should be further understood that the weights 24*a*, 24*b*, 24*c*, 24*d*, 24*e* and 24*f* may be similarly mounted to the plate 16. Of course, the weights 20*a*–20*d* and 22*a*–22*d* are all mounted at a roughly 45° angle relative to the sidewall 12 while the weights 24*a*–24*f* are all mounted at a roughly 90° angle relative to the plate 16.

Before proceeding further in the description of FIG. 4, it should be noted that a variety of configurations may be used for the weights 20*a*–20*d*, 22*a*–22*d* and 24*a*–24*f*. More specifically, while the term "weights" has used heretofore, the weights 20*a*–20*d*, 22*a*–22*d* and 24*a*–24*f* are typically balls, weighted balls or other similarly shaped spherical objects. The balls or other spherically-shaped objects may be formed of wood, plastic, metal or another suitable material. While it is contemplated that the balls or other spherically-shaped objects may be formed in a wide variety of sizes, typically the balls will have a diameter between about one inch and about 2 inches. Similarly, while the balls may be formed to have a wide variety of weights, typically, the balls will have a mass of between about 0.5 pounds and about 1.1 pounds.

Returning now to FIG. 4, the structure used to attach the weight 20*d* to the sidewall 12 of the hand held exercise device 10 will now be described in greater detail. As may now be seen, a first inwardly extending borehole 27 is formed in the weight 20*d*. Preferably, the borehole 27 should be formed such that it extends towards the general center of the weight 20*d*. A generally cylindrical rod 28 is then fixedly inserted into the borehole 27 such that it projects outwardly from the exterior side surface of the weight 20*d*. Preferably, the rod 28 is threaded along the outer side surface thereof. A second inwardly extending borehole 29 is formed in the sidewall 12 of the hand-held exercise device 10 and an insert 30 is fixedly mounted therein. Preferably, the borehole 29 and the insert 30 are sized such that an exposed side surface 30*a* forms a generally contiguous surface with the exterior side surface of the sidewall 12.

Formed in the general center of the insert 30 is an aperture 32 which extends generally parallel to the longitudinal axis C. Preferably, the aperture 32 has dimensions corresponding to the portion of the rod 28 which projects from the exterior side surface of the weight 20*d*. In other words, the diameter of the aperture 32 is generally equal to the diameter of the rod 28 and the depth of the aperture is generally equal to the length of the projecting segment of the rod 28. Even more preferably, the interior side surface of the insert 30 which defines the aperture 32 is threaded to complement the threaded rod 28. In this manner, the rod 28 may be rotatingly inserted into the aperture 32 to removably mount the weight 20*d* to the sidewall 12 of the hand-held exercise device 10.

It was previously noted that the weight 20*d* (as well as the weights 20*a*–20*c* and 22*a*–22*d*) is positioned at about a 45° angle relative to the sidewall 12 to which it is removably mounted. To position the weight 20*d* (as well as the weights 20*a*–20*c* and 22*a*–22*d*) at the desired angle, the aperture 32 should be formed at a general 45° angle relative to the sidewall 12. Of course, to vary the angle at which the weights are mounted relative to the sidewall or other structure to which they are removably mounted, it is only necessary to vary the angle of the aperture which receives the projecting rod relative to the sidewall or other structure in which the aperture is formed. For example, the weights 24*a* through 24*f* mounted to the plate 16 downwardly descend from the plate 16 at a generally orthogonal angle.

Figure 5:
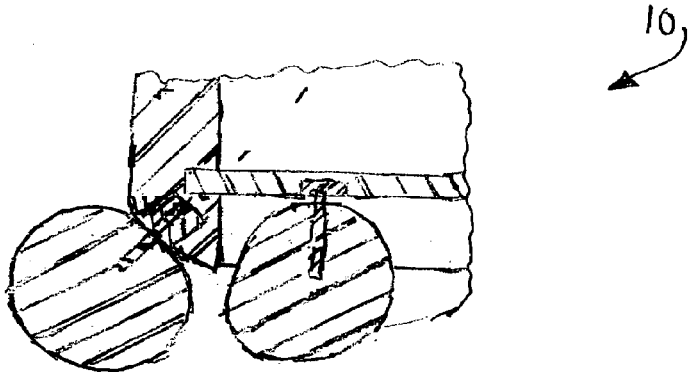
FIG. 5 is a partial cross-sectional view taken along lines 5—5 of FIG. 3.

In FIG. 5, a partial cross-sectional view of the hand-held exercise device 10 taken along lines 5—5 of FIG. 3 may be seen.

Figure 6:
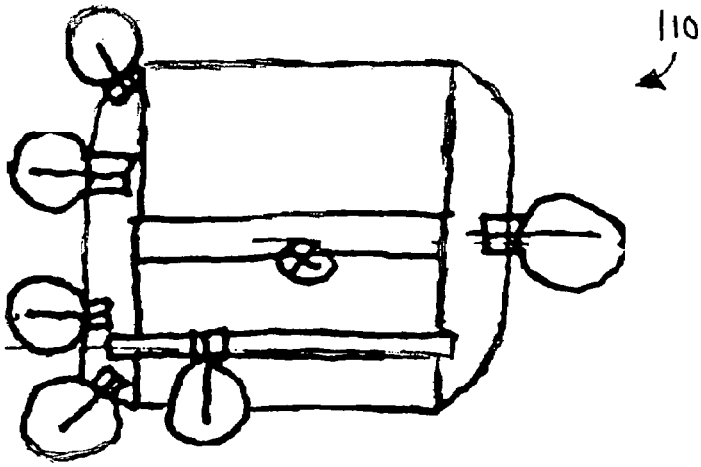
FIG. 6 is a cross-sectional view of an alternate configuration of the hand-held exercise device of FIG. 1.

In FIG. 6, a cross-sectional view of an alternate embodiment of the hand-held exercise device 10, hereafter referred to as hand-held exercise device 110 may be seen.

Figure 7:
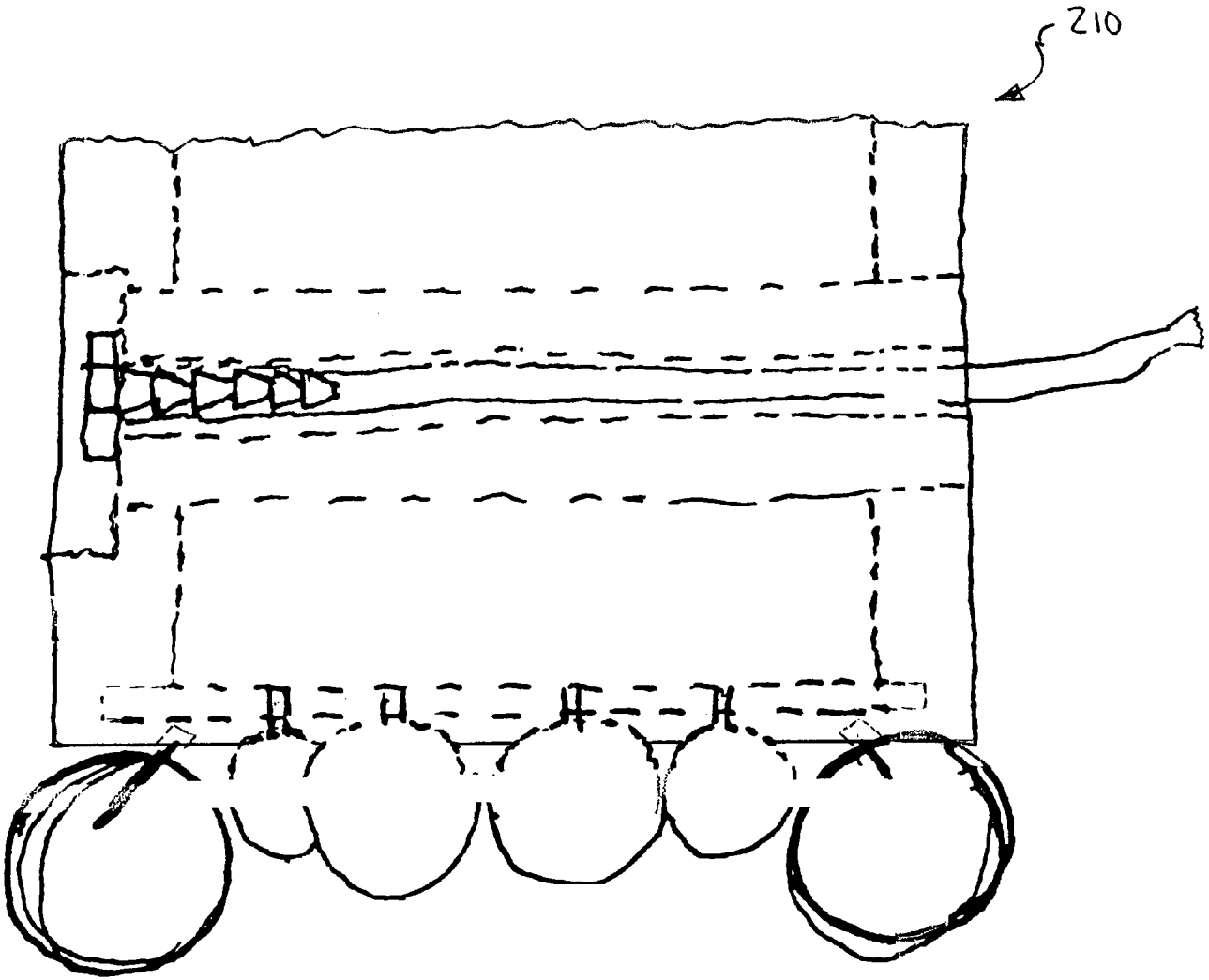
FIG. 7 is a partial side view of an alternate embodiment of the hand-held exercise device.

In FIG. 7, a partial side view of another alternate embodiment of the hand-held exercise device 10, hereafter referred to as hand-held exercise device 210 may be seen.

Figure 8:
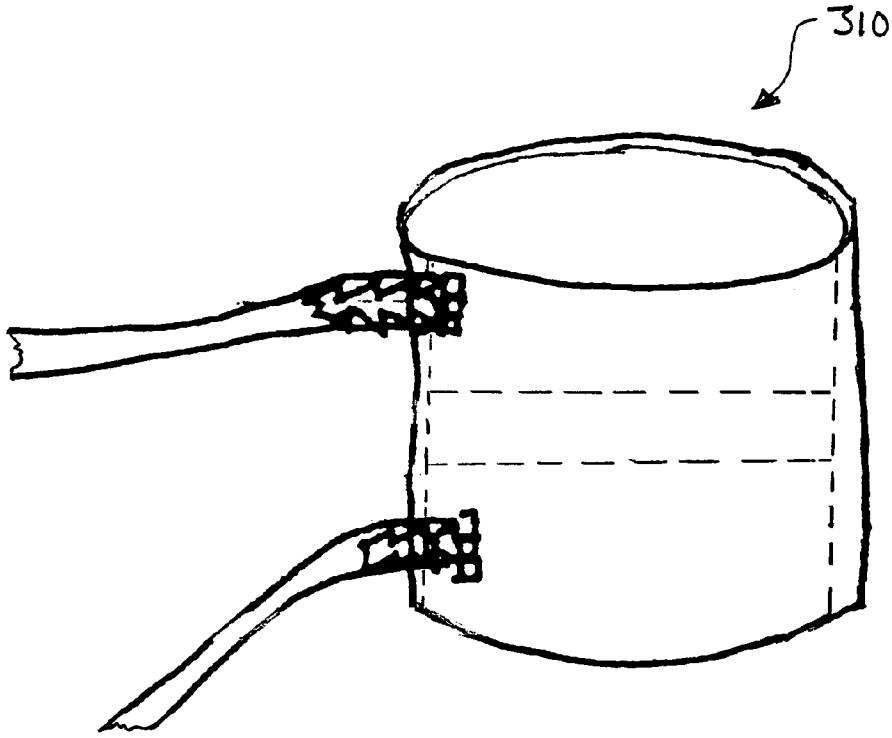
FIG. 8 is a perspective view of another alternate embodiment of the hand-held exercise device.

In FIG. 8, a perspective view of yet another alternate embodiment of the hand-held exercise device 10, hereafter referred to as hand-held exercise device 310 may be seen.

Figure 9:
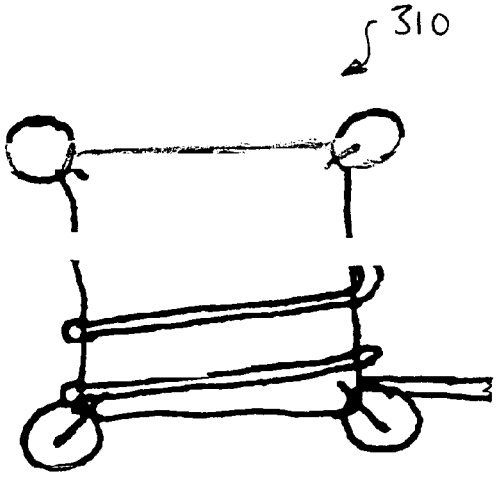
FIG. 9 is a first front view of the hand-held exercise device of FIG. 8 illustrating a first sidewall tracking configuration.

In FIG. 9, a first front view of the hand-held exercise device 310 may be seen. Here, the hand-held exercise device 310 includes a first sidewall tracking configuration.

Figure 10:
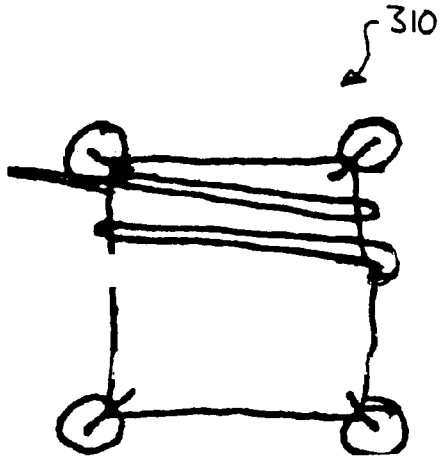
FIG. 10 is a second front view of the hand-held exercise device of FIG. 8 illustrating a second sidewall tracking configuration.

In FIG. 10, a second front view of the hand-held exercise device 310 may be seen. Here, the hand-held exercise device 310 includes a second sidewall tracking configuration.

Figure 11:
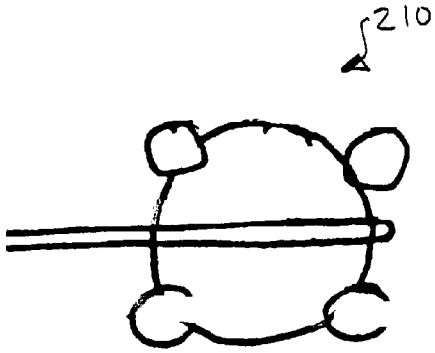
FIG. 11 is a first bottom view of the hand-held exercise device of FIG. 7.

FIG. 11 is a first bottom view of the hand-held exercise device of FIG. 7.

Figure 12:
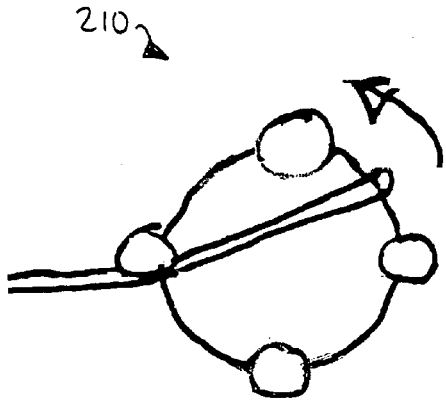
FIG. 12 is a second bottom view of the hand-held exercise device of FIG. 7 illustrating a moment arm change therefor.

FIG. 12 is a second bottom view of the hand-held exercise device of FIG. 7 illustrating a moment arm change therefor.

Figure 13:
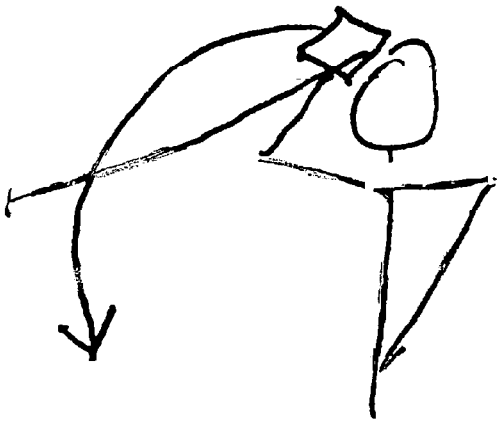
FIG. 13 illustrates a first movement arc for the hand-held exercise device of FIG. 7.

FIG. 13 illustrates a first movement arc for the hand-held exercise device of FIG. 7.

Figure 14:
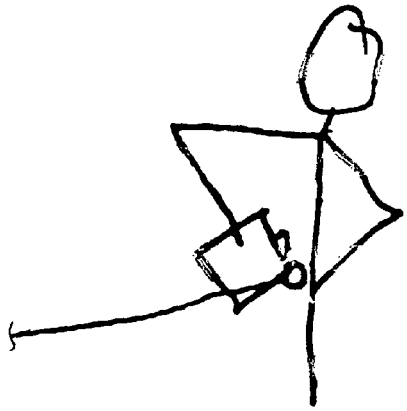
FIG. 14 illustrates a second movement arc for the hand-held exercise device of FIG. 7.

FIG. 14 illustrates a second movement arc for the hand-held exercise device of FIG. 7.

It is contemplated that the hand-held exercise device described and illustrated herein has plural use modes. A first use mode is directed to the use of the so-called "small hand" hand-held exercise device with associated ball-weight system by one hand. A second use mode is directed to the use of the so-called "small hand" hand-held exercise device with associated ball-weight system by both hands. A third use mode is directed to the use of the so-called "small hand" hand-held exercise device with associated ball-weight system by one hand in which the hand-held exercise device is attached to a flexible lead (see FIG. 7). Finally, a fourth use mode is directed to the use of the so-called "small hand" hand-held exercise device by both hand in which both hand-held exercises devices are attached to flexible leads (again, see FIG. 7).

Thus, there has been described and illustrated herein, a hand-held exercise device incorporating a variable stability strength overload distribution system resulting from the even or uneven distribution of weight relative to a center of gravity thereof, for example, the even or uneven distribution of weight along one or more planes generally parallel to a handle assembly thereof. By configuring a hand-held exercise device in the manner described and illustrated herein, a wide variety of exercise routines which, in the past, have proven ineffective when attempted using a traditionally configured dumbbell, will now produce the desired result. However, those skilled in the art should recognize that numerous modifications and variations may be made in the apparatus and techniques disclosed herein without departing substantially from the spirit and scope of the invention. Accordingly, it is intended that the scope of the present invention only be limited by the terms of the claims appended hereto.

What is claimed is:

1. A hand-held exercise device comprising:

a generally tubular sidewall having an upper side surface, a lower side surface, an interior side surface and an exterior side surface;

a handle having a first end attached to a first location along said interior side surface of said generally tubular sidewall and a second end attached to a second location along said interior side surface of said generally tubular sidewall;

a plate mounted to said lower side surface of said sidewall;

a first array of weights, said first array of weights comprised of at least one weight removably attached to said upper side surface of said generally tubular sidewall;

a second array of weights, said second array of weights comprised of at least one weight removably attached to said lower side surface of said generally tubular sidewall; and a third array of weights, said third array of weights comprised of at least one weight removably attached to a lower side surface of said plate.

2. The hand-held exercise device of claim 1, wherein said first array is comprised of between one and four weights, said second array is comprised of between one and four weights and said third array is comprised of between one and six weights.

3. The hand-held exercise device of claim 1, wherein each of said first, second and third array of weights are comprised of a plurality of weights which range from a first, low weight to a second, high weight.

4. The hand-held exercise device of claim 3, wherein said low weight is about 0.5 pounds and said high weight is about 1.0 pounds.

5. The hand-held exercise device of claim 3, wherein:

said first array of weights are spaced generally equidistant around a periphery of said upper side surface of said generally tubular sidewall;

said second array of weights are spaced generally equidistant around a periphery of said lower side surface of said generally tubular sidewall; and said third array of weights are spaced equidistant around a periphery of said lower side surface of said plate.

6. The hand-held exercise device of claim 5, wherein each of said at least one weight of each of said first, second and third arrays of weights are generally spherical in shape.

7. The hand-held exercise device of claim 6, wherein:

each of said at least one weight of said first array of weights further comprises a projecting shaft insertably received in a corresponding aperture extending inwardly from said upper side surface of said generally tubular sidewall, to removably attach said first array of weights to said upper side surface of said generally tubular sidewall;

each of said at least one weight of said second array of weights further comprises a projecting shaft insertably received in a corresponding aperture extending inwardly from said lower side surface of said generally tubular sidewall, to removably attach said second array of weights to said lower side surface of said generally tubular sidewall; and each of said at least one weight of said third array of weights further comprises a projecting shaft insertably received in a corresponding aperture extending inwardly from said lower side surface of said plate to removably attach said third array of weights to said lower side surface of said plate.

8. The hand-held exercise device of claim 7, wherein:

each of said at least one weight of said first array extends upwardly at an approximately 45 degree angle relative to a horizontal axis of said generally tubular sidewall;

each of said at least one weight of said second array extends downwardly at an approximately 45 degree angle relative to said horizontal axis of said generally tubular sidewall; and each of said at least one weight of said third array extends downwardly at a generally orthogonal angle relative to said plate.

9. The hand-held exercise device of claim 8, wherein:

said first array is comprised of between one and four weights, each having a weight between about 0.5 pounds and about 1.0 pounds;

said second array is comprised of between one and four weights, each having a weight between about 0.5 pounds and between about 1.0 pounds; and said third array is comprised of between one and six weights, each having a weight between about 0.5 pounds and about 1.0 pounds.

10. The hand-held exercise device of claim 9, wherein:

said first and second locations along said interior side surface of said generally tubular sidewall at which said handle is fixedly mounted are roughly midway between said upper and lower side surfaces of said generally tubular sidewall; and said upper side surface of said generally tubular sidewall defines an access opening through which a user may grasp said handle of said hand-held exercise device.

11. A hand-held exercise device, comprising:

a generally tubular sidewall having an inner surface which defines an interior space and a first annular surface which defines an aperture through which said interior space may be accessed;

a handle attached to said inner surface of said generally tubular sidewall, said handle extending across said interior space; and a first array of weights removably attached to said first annular surface of said generally tubular sidewall;

wherein said first array of weights are spaced equidistant from one another along said first annular surface; and wherein said first array of weights have respective weights which range from a first, low weight to a second, high weight.

12. The hand-held exercise device of claim 11, wherein said first array of weights are positioned to extend away from said first annular surface at an angle of about +45 degrees.

13. The hand-held exercise device of claim 11, wherein:

said generally tubular sidewall further comprises a second annular surface;

said hand-held exercise device further comprises a second array of weights removably attached to said second annular surface of said generally tubular sidewall;

said second array of weights are spaced equidistant from one another along said second annular surface; and said second array of weights have respective weights which may range from a third, low weight to a fourth, high weight.

14. The hand-held exercise device of claim 13, wherein said first array of weights are positioned to extend away from said first annular surface at an angle of about +45 degrees and said second array of weights are positioned to extend away from said second annular surface at an angle of about −45 degrees.

15. The hand-held exercise device of claim 13, and further comprising:

a plate mounted to said second annular surface; and a third array of weights removably attached to said plate;

wherein said third array of weights are spaced equidistant from one another along said plate; and wherein said third array of weights have respective weights which may range from a fifth, low weight to a sixth, high weight.

16. The hand-held exercise device of claim 15, wherein said first array of weights are positioned to extend away from said first annular surface at an angle of about +45 degrees, said second array of weights are positioned to extend away from said second annular surface at an angle of about −45 degrees and said third array of weights are positioned to extend away from said plate annular surface at an angle of about −90 degrees.

17. The hand-held exercise device of claim 16, wherein said first array is comprised of four weights ranging between about 0.5 and about 1.0 pounds, said second array is comprised of four weights ranging between about 0.5 and about 1.0 pounds and said third array is comprised of six weights ranging between 0.5 and about 1.0 pounds.

* * * * *